US010648661B2

(12) United States Patent
Howe et al.

(10) Patent No.: US 10,648,661 B2
(45) Date of Patent: May 12, 2020

(54) COAL NOZZLE ASSEMBLY COMPRISING TWO FLOW CHANNELS

(71) Applicant: General Electric Technology GmbH, Baden (CH)

(72) Inventors: Kevin Michael Howe, Windsor, CT (US); John Childs Lewis, Windsor, CT (US); Alfred Josef Gwosdz, Stuttgart (DE)

(73) Assignee: General Electric Company, Schenectady, NY (US)

( * ) Notice: Subject to any disclaimer, the term of this patent is extended or adjusted under 35 U.S.C. 154(b) by 87 days.

(21) Appl. No.: 16/051,433

(22) Filed: Jul. 31, 2018

(65) Prior Publication Data

US 2019/0032914 A1 Jan. 31, 2019

(30) Foreign Application Priority Data

Jul. 31, 2017 (EP) ..... 17184062

(51) Int. Cl.

| | |
|---|---|
| ***F23D 1/00*** | (2006.01) |
| ***F23C 5/06*** | (2006.01) |
| ***F23C 13/06*** | (2006.01) |
| ***F23C 13/08*** | (2006.01) |

(52) U.S. Cl.

CPC ..... *F23D 1/00* (2013.01); *F23C 5/06* (2013.01); *F23C 13/06* (2013.01); *F23C 13/08* (2013.01); *F23D 2201/101* (2013.01); *F23D 2201/20* (2013.01); *F23D 2900/00001* (2013.01); *F23D 2900/00003* (2013.01)

(58) Field of Classification Search

CPC .. F23D 1/00; F23D 2201/10; F23D 2201/101; F23D 2900/00003; F23C 5/06

See application file for complete search history.

(56) References Cited

U.S. PATENT DOCUMENTS

| | | | | |
|---|---|---|---|---|
| 1,721,879 A * | 7/1929 | Hazlehurst | F23D 1/00 110/104 B |
| 4,252,069 A * | 2/1981 | McCartney | F23C 5/06 110/104 B |
| 5,464,344 A * | 11/1995 | Hufton | F23C 9/006 431/10 |

FOREIGN PATENT DOCUMENTS

| | | |
|---|---|---|
| CA | 1136924 A | 12/1982 |
| DE | 19729607 A1 | 1/1999 |
| WO | 2009114331 A2 | 9/2009 |

OTHER PUBLICATIONS

Search Report and Examination from corresponding EP Application No. 17184062.2 dated Feb. 5, 2018.

* cited by examiner

*Primary Examiner* — David J Laux

(74) *Attorney, Agent, or Firm* — Charlotte C. Wilson; James W. Pemrick

(57) ABSTRACT

A coal nozzle assembly for a steam generation apparatus comprising an elongated nozzle body having a nozzle tip at one end thereof; said nozzle tip comprising two channels, each channel having curved or buckled flow paths, the nozzle tip further comprising parting means separating the channels from each other, wherein the directions of the flow paths of the channels at their ends distal from the nozzle body enclose an angle between 0° and 90°. This promotes intersecting and shearing the two partial streams outside the nozzle assembly resulting in a better combustion with reduced NOx-emissions.

15 Claims, 5 Drawing Sheets

COAL NOZZLE ASSEMBLY COMPRISING TWO FLOW CHANNELS

BACKGROUND OF INVENTION

This disclosure relates to a nozzle assembly for a steam generation apparatus for directing the flow of solid particles entrained in primary air into a combustor or furnace. It further relates to a steam generating system which comprises a furnace and at least one coal nozzle assembly.

PRIOR ART

A solid fueled firing system burns powdered solid fuel, typically cowl, blown into a furnace in a stream of air. This furnace is typically a boiler that creates steam for various uses, such as creating electricity.

When the pulverized coal particles are conveyed through the duct work from the coal mill to the coal nozzle assembly by means of primary air they tend to aggregate at various paths. The resulting partial separation of coal particles and the primary air among other negative effects reduce the burning efficiency in the furnace and raise the pollutants in the fuel gas, which is undesirable.

From U.S. Pat. No. 8,955,776 a stationary nozzle for solid fueled furnaces is known comprising several flat guide vanes arranged parallel to each other in the exit area of the nozzle to direct the flow of primary air and coal particles into the furnace.

The nozzle and the guide vanes are integrally formed for example by casting. The guide vanes are more or less parallel to each other resulting in a sub-optimal mixture of the partially aggregated coal particles and the primary air before exiting the nozzle and entering the furnace.

Currently, there is a need for an improved coal nozzle assembly resulting in a more homogenous mixture of coal particles and primary air just before being burnt in the furnace thus resulting in a higher efficiency of the furnace and less pollutants, like for example NOx, in the flue gas.

SUMMARY OF THE INVENTION

In a first embodiment the coal nozzle assembly comprises an elongated nozzle body having a nozzle tip at one end thereof; said nozzle tip comprising two channels each channel having a curved or buckled flow paths, the nozzle tip further comprising parting means separating the channels from each other, wherein the directions of the flow paths of the channels at their ends distal from the nozzle body enclose an angle greater than 0° and equal to or less than 90°.

In a second embodiment the coal nozzle assembly comprises an elongated nozzle body and an inner shell having two nozzle tips at one end thereof; the nozzle assembly further comprising parting means being located in the inner shell upstream of said two nozzle tips and splitting the flow from said nozzle body into the two nozzle tips, the directions of the flow paths of the two nozzle tips of the second embodiment enclosing an angle $\alpha$ greater than 0° and equal to or less than 90°.

Both embodiments of the invention make use of a two-step approach. The first step takes place as the non-homogeneous stream of coal particles and primer), air exits the nozzle body and enters the nozzle tip. This stream is split into two partial streams inside the tip by parting means. Inside the tip according to the first embodiment or by means of the two nozzle tips two partial streams are redirected such that they will intersect and shear against one another upon exit, which is the second step. To achieve this intersection and shear among others the exit faces through which the partial streams exit the nozzle tip encloses an angle greater than 90° and less than 180°. This shearing causes an external mixing of the two partial streams, helping to break up the coal stream resulting in a very efficient combustion and low emissions.

The coal nozzle assemblies according to the invention generate a well-mixed and rather homogenous stream of coal and primary air by mixing the coal particles and the primary air in the furnace immediately before the combustion takes place, rather than solely relying on mixing inside the tip.

To allow a further improved mixing of coal particles and primary air depending on the locally different operating conditions in a furnace, the nozzle tips are being mounted for pivotal movement about an axis being orthogonal with respect to the longitudinal axis of the elongate body. In most cases this axis is horizontal.

To ensure that almost 100% of the coal particles and the primary air enter the nozzle tip or the nozzle tips the nozzle body partially overlaps the nozzle tips.

The plane walls and the bent walls of the claimed nozzle tip limit a rectangular cross section of the nozzle tip. Further, the nozzle body may have rectangular or truncated pyramid longitudinal section, thus speeding up the velocity of the primary air and the coal particles before entering the nozzle tip.

It has proven advantageous, if the directions of the flow paths of the channels at their ends distal from the nozzle body enclose an angle $\alpha$ greater than 15°, preferably greater than 30° and/or less than 75°, preferably less than 60.

Keeping the angle $\alpha$ between the directions of the flow paths of the channels within these limits results in a good intersection and shearing of the two partial streams of coal and air resulting in a stable and clean flame in front of the nozzle tip.

To bring the ignition point closer to the tip and to provide improved flame stability one or two shear bars may be fixed at each nozzle tip near the exit face.

For cooling purposes and to further improve the mixture of primary air and coal particles a perimeter of secondary air may surround the coal nozzle tip.

For further improved mixing abilities each nozzle tip comprises a splitter plate extending between the two plane walls to direct the flow of air and coal particles.

Further advantages are disclosed in the figures, their description and the claims.

DETAILED DESCRIPTION OF THE DRAWINGS

Figure 1:
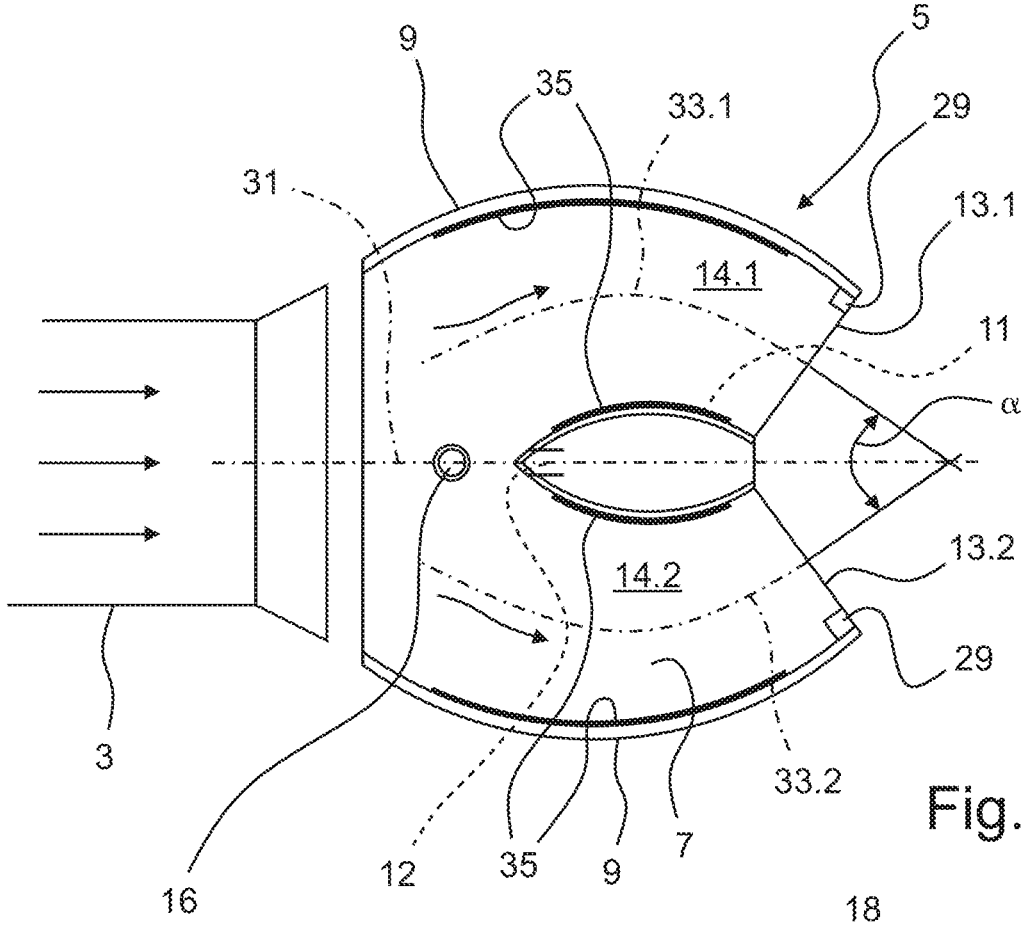
FIG. 1: A side view of a first embodiment of a nozzle body and a nozzle tip according to the invention (exploded view)

FIG. 1 shows an exploded side view of a nozzle body 3 and a nozzle tip 5 according to the invention. The nozzle tip 5 has an axis symmetry 31. The nozzle tip 5 of this embodiment is comprised of two parallel plane walls 7, only one of them being visible in FIG. 1.

The nozzle tip 5 of this embodiment further comprises two curved or buckled walls 9. These two pairs of walls 7, 9 are the outer boundary or housing of the nozzle tip 5. Inside this housing parting means 11 are located. The parting means 11 extend from one (plane) wall 7 to the other (plane) wall 7. The parting means 11 are shaped so that a leading edge 12 splits the flow from the nozzle body 3 into two partial streams.

Between the bent walls 9 and the parting means 11 two nozzle type channels 14.1, 14.2 are formed. The cross section of the channels 14 of this embodiment is rectangular (not visible in FIG. 1).

Due to that the flow paths of the primary air and the entrained coal particles are curved or buckled. The term "flow path" in conjunction with this invention has to be understood such that the main direction or the transport direction of the primary air and the coal is meant. In addition to that local and/or temporary deviations of the flow of the primary air from the flow path may occur, for example due to turbulent flow of the primary air. These deviations do not have an influence on the direction of the flow path.

Since a flow path as defined above cannot be illustrated properly in the figures to visualize, the flow paths the figures comprise arrows (without reference numerals).

Further, to visualize the flow paths and their directions when exiting the nozzle tip 5 curved and straight longitudinal axes 33.1, 33.2 are shown in the figures. In conjunction with the claimed invention the terms "longitudinal axes 33.1, 33.2" and "flow paths" are synonyms.

Consequently, the longitudinal axes 33.1, 33.2 of the channels 14.1, 14.2 are curved or buckled, too. In this embodiment the channels 14.1, 14.2 are arranged symmetrically with regard to the axis of symmetry 31 of the nozzle tip 5.

The primary air and the coal particles flow through the nozzle body 3 and the channels 14.1 and 14.2 as illustrated by arrows. The air and coal particles exit the channels 14.1, 14.2 via exit faces 13.1 and 13.2. The cross section of the exit faces 13.1, 13.2 of this embodiment is rectangular (not visible in FIG. 1).

The longitudinal axes 33.1, 33.2 at an end of the channels 14.1, 14.2 distal from nozzle body 3 (and near the exit faces 13.1 and 13.2) enclose an angle $\alpha$ being greater than 0° and equal or less than 90°. In this particular embodiment the angle $\alpha$ is about 60°. This means that the flow directions of the primary air exiting the channels 14.1, 14.2 via the exit faces 13.1, 13.2 enclose an angle equal to the angle $\alpha$. The flow direction of the primary air when exiting the nozzle tip via the exit faces is perpendicular to the exit faces.

It is possible to apply a catalyst 35 to the internal surfaces of the nozzle tip 5 that are exposed to the primary air and coal particles.

The curved or buckled channels 14.1, 14.2 direct the partial flows of the air and the coal particles such that they intersect and shear after having left the nozzle tip 5 just before they are combusted. This results in a more homogenous mixture of primary air and coal particles before and during combustion. Due to that the efficiency of the flame is improved and emissions are reduced.

As an option (not illustrated in FIG. 1) splitter plates may be arranged in the channels 14.1, 14.2 near the exit faces 13.1, 13.2.

Figure 2:
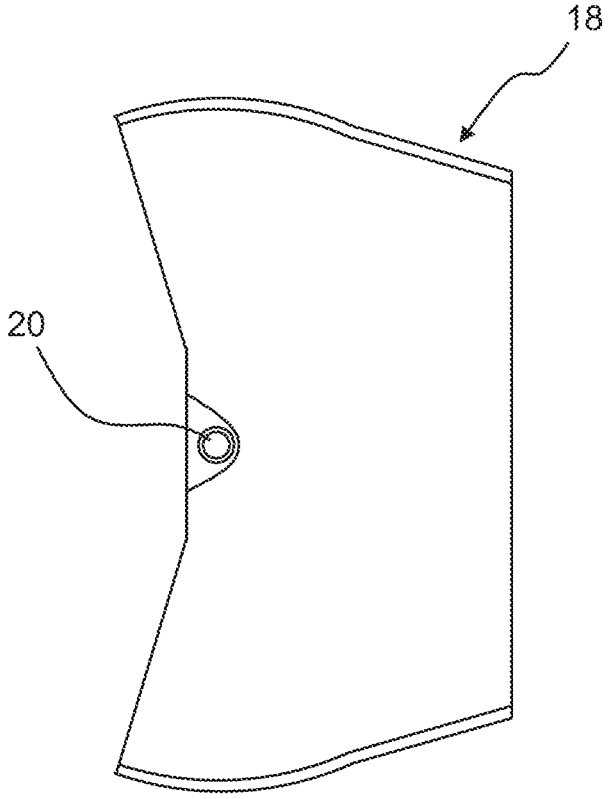
FIG. 2: A side view of the outer housing surrounding the nozzle tip.

FIG. 2 shows a side view of an outer housing or air housing 18. The air housing 18 surrounds the nozzle body 3 and the nozzle tip 5 and is spaced from them. Combustion or secondary air is admitted to the region defined between the nozzle body 3 and the nozzle tip 5 on one side and the air housing 18 on the other side. In other words: a perimeter of secondary air surrounds the coal nozzle tip 5.

Figure 3:
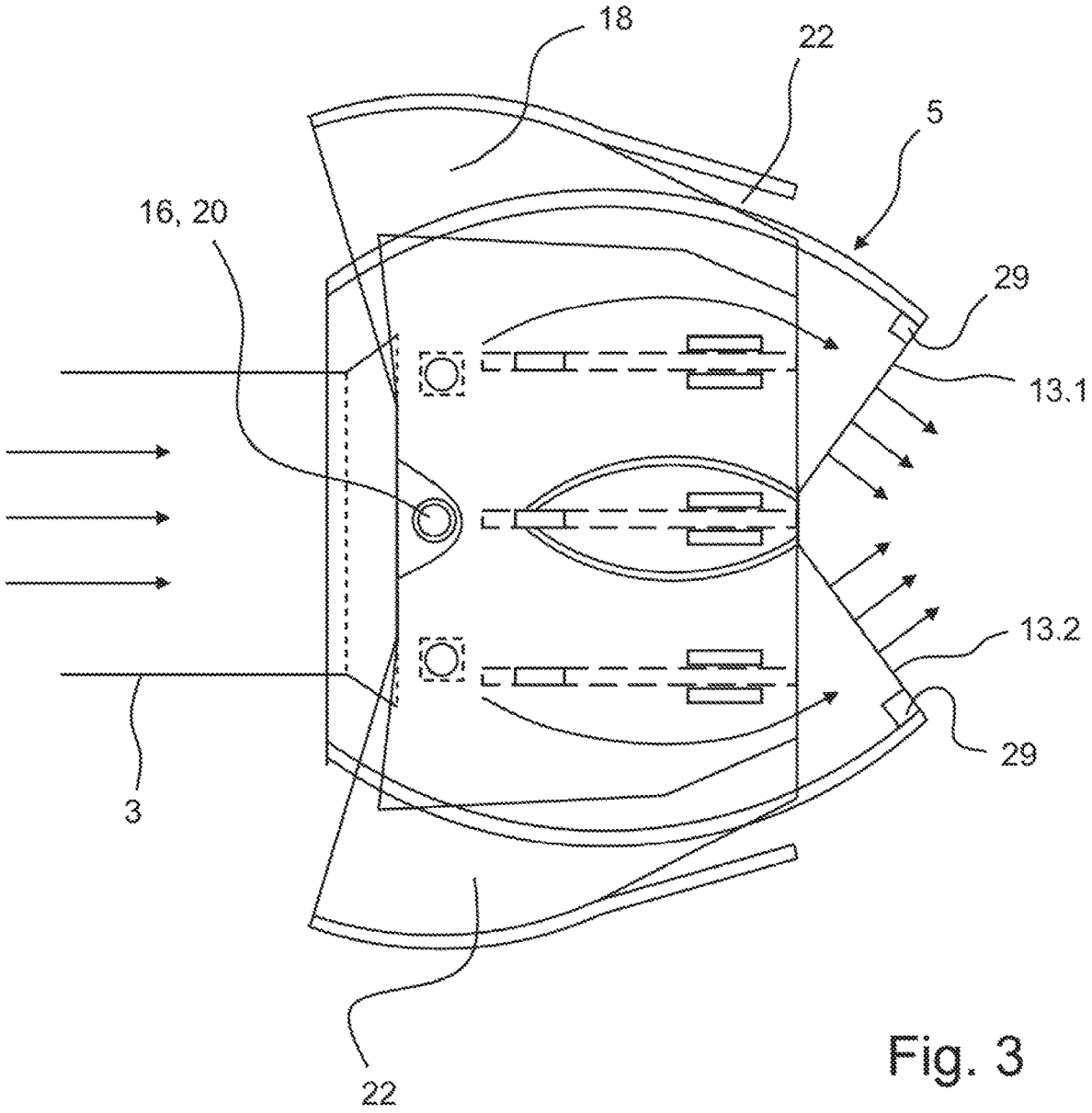
FIG. 3: A side view of the nozzle body, mounted nozzle tip end outer housing according to FIGS. 1 and 2, FIG. 4: A schematic cross section through a second embodiment of the claimed coal nozzle assembly, FIG. 5 illustrating the flow of the coal and the primary air through the second embodiment according to FIG. 4 and, FIG. 6: A perspective view of the second embodiment.

FIG. 3 shows an assembled first embodiment of the claimed nozzle tip. For reasons of clarity not all reference numerals are drawn.

As an option the nozzle tip 5 is pivotally connected to the air housing 18 by a pair of pivot members 16, 20. In FIG. 1 a pivot pin 16 is visible. The air housing 18 comprises a bearing 20 for the pivot pin 16 (c. f. FIG. 2). The pivot members 16, 20 allow the nozzle tip 5 to be rotated or to be tilted about an axis (in most cases a horizontal axis) so that the fuel and combustion air can be directed upwardly or downwardly with respect to a vertical axis of the furnace. The pivotal connection of the nozzle tip 5 allows a redirection of the air within a range of approximately ±30°. In a simplified embodiment of the nozzle tip 5 is not pivotably mounted.

As can be seen from FIGS. 1 and 3, near the exit faces 13.1 and 13.2 shearing bars 29 swirl and direct the air and coal particles exiting the exit faces 13.1 and 13.2 such that the ignition point of the flame comes closer to the nozzle tip 5 and provides improved flame stability. The shear bars 29 are optional.

In FIG. 3 a channel 22 limited by the air housing 18 on one side and by the nozzle body 3 and the nozzle tip 5 on the other side can be seen. Through this channel 22 a perimeter of secondary air flows into the furnace. Before entering the furnace secondary air cools the nozzle tip 5 and additionally mixes the coal particles and the air before being combusted. It is further advantageous to reduce the height of the channel 22 to a minimum near the exit faces 13.1, 13.2 to accelerate the secondary air.

Figure 4:
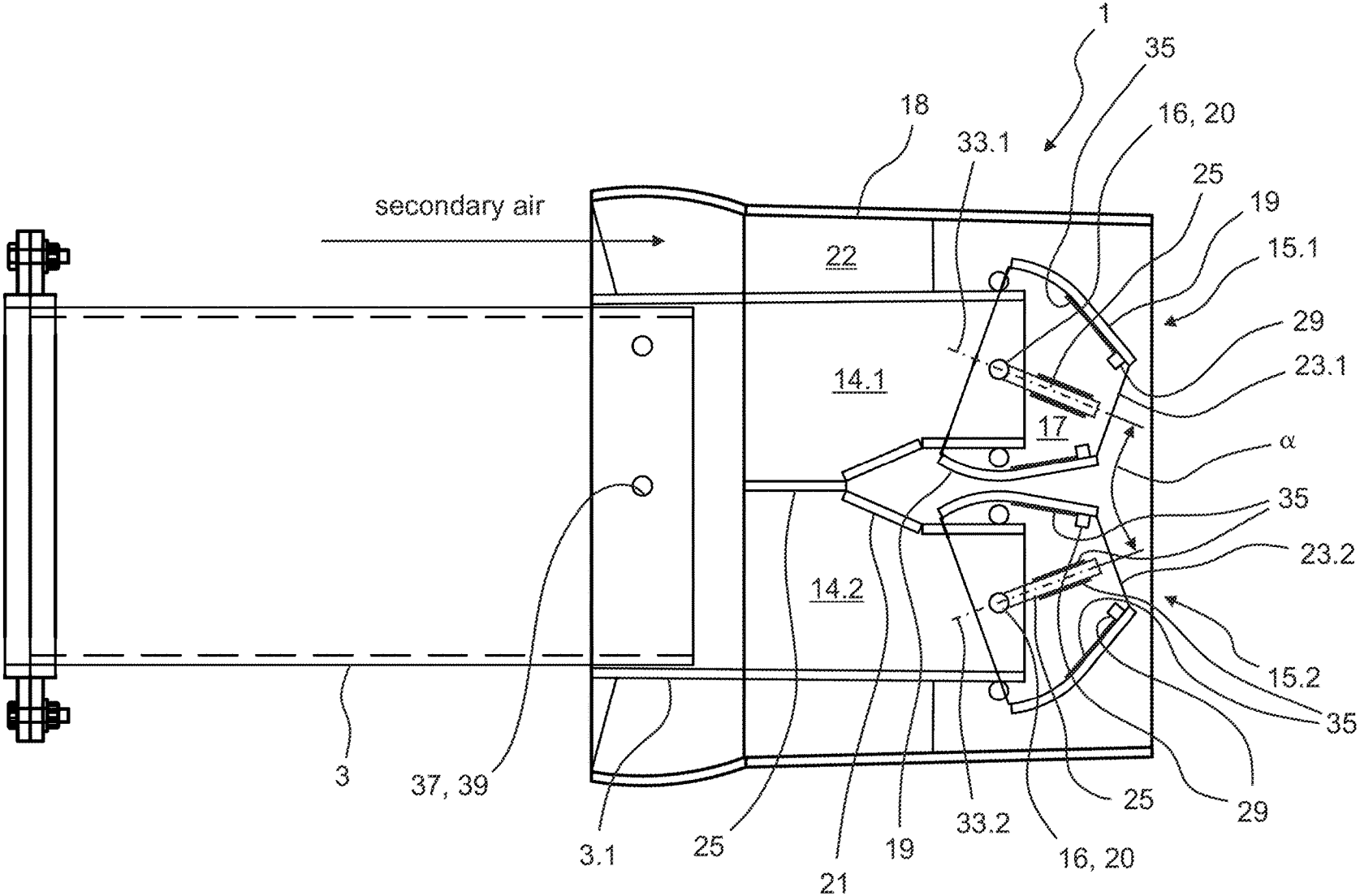
Figure 5:
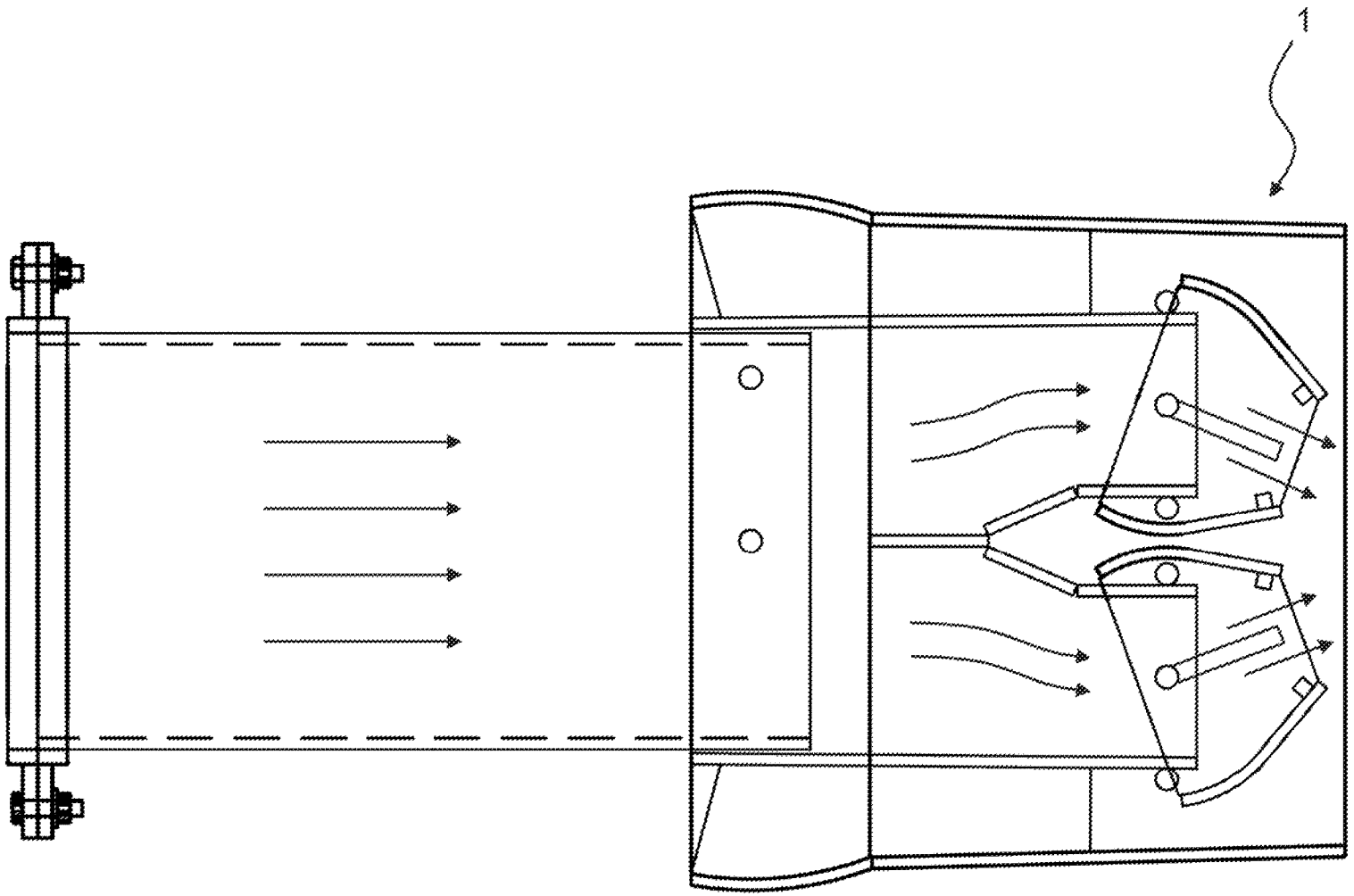

FIGS. 4 and 5 illustrate a second embodiment of the claimed invention. Similar parts have the same reference numerals as the first embodiment (FIGS. 1 to 3).

In this embodiment the nozzle body 3 is attached to an inner shell 3.1 of the nozzle assembly 1. It further comprises two nozzle tips 15.1 and 15.2, each being pivotably mounted to the inner shell 3.1 by means of pivot pins 16 and the respective bearings 20.

Upstream of the entrance of the nozzle tips 15.1 and 15.2 parting means 21 are installed in the inner shell 3.1 splitting the flow through the nozzle body 3 into two partial flows and forming together with the inner shell 3.1 two channels 14.1, 14.2. Each channel 14.1, 14.2 supplies approximately a half of the flow through the nozzle body 3 to each of the nozzle tips 15.1 and 15.2.

The directions of the flow paths and the longitudinal axes 33.1 and 33.2 of the nozzle tips 15.1 and 15.2 enclose an angle $\alpha$ between 90° and 0° (illustrated is an angle of approximately 40°). This promotes intersecting and shearing the two partial streams outside the nozzle assembly 1 with the above-mentioned positive results.

Since both nozzle tips 15.1 and 15.2 may be tilted independently, it is possible to adjust the angle $\alpha$ between the directions of the flow paths and/or the longitudinal axes 33.1 and 33.2 of the nozzle tips 15.1 and 15.2 such that an optimal combustion is achieved. Further, it is possible, to adjust the ignition point of the flame.

Similar to the first embodiment the outer housing 18 and the inner shell 3.1 and the nozzle tips 15.1, 15.2 limit a channel 22 through which the a.m. a perimeter of secondary air for cooling the nozzle tips 15.1 and 15.2 flows.

It is possible that the outer housing 18 and the inner shell 3.1 are pivotally mounted by means of means of pivot pins 37, 39 such that they can be tilted about an angle of approximately +/−30°.

For further improved mixing abilities each nozzle tip 15.1, 15.2 and 15 may comprise a splitter plate 25 disposed near the exit faces 13.1, 13.1, 23.1, and 23.3 to direct the flow of air and coal particles.

FIG. 5 illustrates the flow, of the primary air through the nozzle assembly 1 and further illustrates the intersection and shearing of the two partial streams after having left the nozzle tips 15.1, 15.2.

Figure 6:
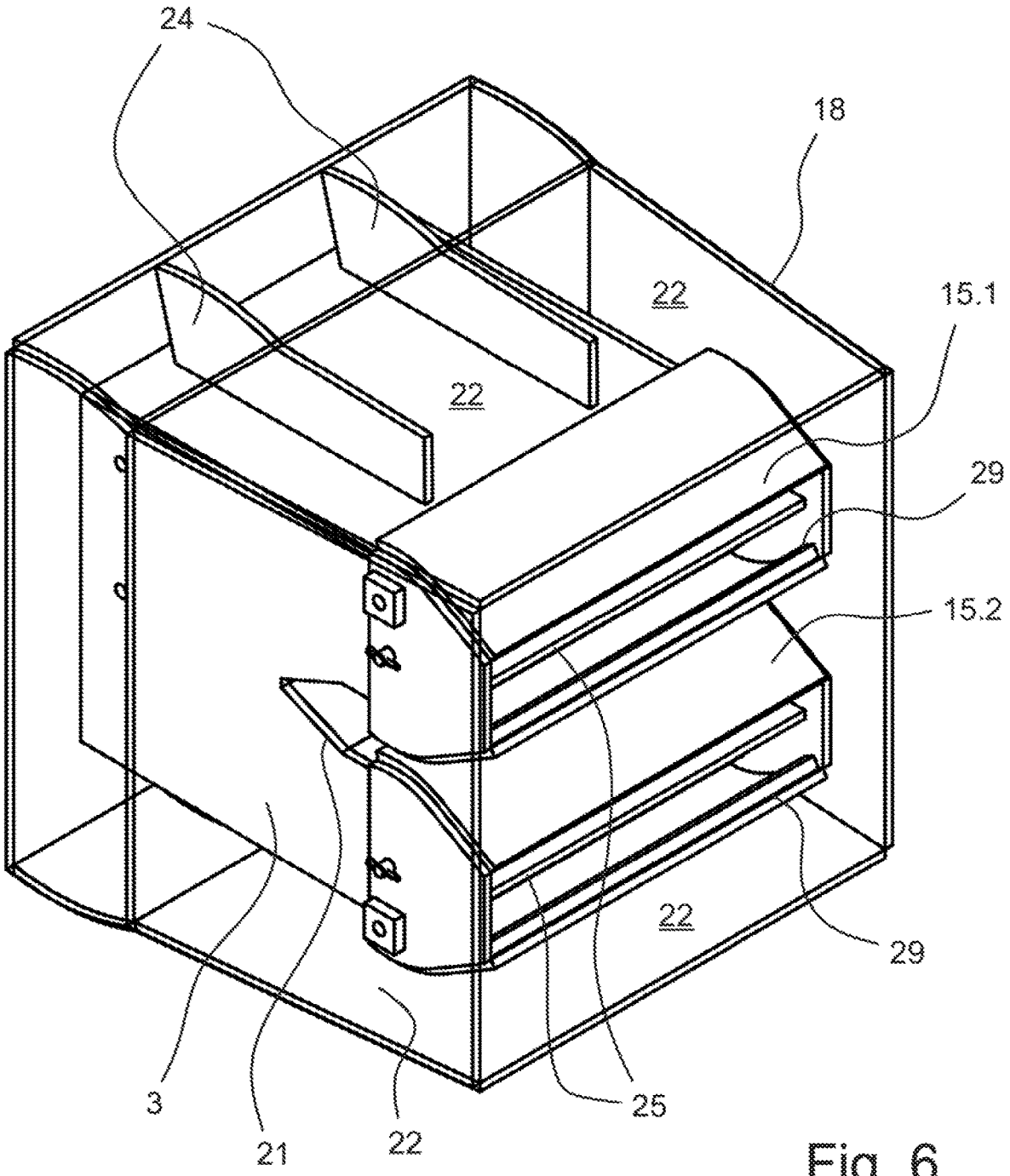

FIG. 6 illustrates a perspective view of the second embodiment. From this perspective view it can be seen that between the outer housing 18 and the nozzle body 3.1 a channel 22 for cooling the nozzle tips 15.1 and 15.2 exists.

Further it can be seen that between the air housing 18 and the inner shell 3.1 a plurality of ribs 24 is disposed. They are welded to the inner surface of the air housing 18 and to the outer surface of the elongated nozzle body 3.1 forming the structural framework of the nozzle tip 1. The ribs 24 may further serve as 22 guiding means for the secondary air.

As illustrated in FIG. 6 the exit faces 23.1 and 23.2 may enclose an angle of 180° (this means that the flow paths are parallel). In some cases this may be the optimal direction for the flow of primary air and coal particles exiting the nozzle 15.1 and 15.2.

To further reduce the NOx emissions of the claimed Ultra-Low NOx burner nozzles a catalyst 35 is applied to the surfaces of the nozzle tip(s) that are exposed to the primary air and the coal particles. Catalytic combustion of the volatile matter in the injected fuel is achieved at temperatures favorable for the reduction of NOx species originating from the volatile matter or partial combustion of solid fuels. Catalytic combustion inside the nozzle tip also improves the quality of the flame downstream and corresponding reduced NOX emission within the furnace.

Catalytic combustion of the volatile matter in the injected fuel is achieved at temperatures favorable for the reduction of NOx species originating from the volatile matter or partial combustion of solid fuels. Catalytic combustion near the exit face(s) of the nozzle tip(s) also improves the quality of the flame and corresponding reduced NOX emission within the furnace.

In an embodiment of this invention, the catalyst is of the perovskite-type with catalytic activity in the preferred temperature range, but not limited to, of 500° C. to 900° C. In an embodiment of this invention, the catalyst is Lanthanum, Strontium and/or Titanate doped with metals. Such metals are, but are not limited to, Fe, Mn, and Co.

The claimed invention is also directed to a method to operate a steam generating system which comprises a furnace and at least one coal nozzle assembly according to one of the foregoing claims by initially adjusting the angle α of the nozzle tips 5, 15.1, 15.2 during commissioning such that optimal combustion is achieved.

It is further directed to a method of adjusting the angle α of the nozzle tips 5, 15.1, 15.2 during operation of the system as a function of the load of the steam generating system and/or dependent from burned fuel properties such as chemical composition and/or particle size.

What we claim is:

1. A coal nozzle assembly for a steam generation apparatus comprising an elongated nozzle body having a nozzle tip at one end thereof; said nozzle tip comprising two channels each channel having a curved or buckled flow path, the nozzle tip further comprising means separating the channels from each other and splitting a stream of coal particles and primary air exiting the nozzle body into two partial streams inside the nozzle tip, wherein the directions of the flow paths of the channels at their ends distal from the nozzle body enclose an angle greater than 0° and equal to or less than 90° wherein the partial streams are redirected inside the nozzle tip through the curved or buckled flow paths such that they intersect and shear against each other upon exit of the nozzle tip before they are combusted.

2. A steam generating system which comprises a furnace and at least one coal nozzle assembly according to claim 1.

3. A method to operate a steam generating system which comprises a furnace and at least one coal nozzle assembly according to claim 1, the method comprising initially adjusting an angle of the nozzle tips during at least one of commissioning and adjusting the angle of the nozzle tips during operation of the system as a function of at least one of the load of the steam generating system and/or dependent from burned fuel.

4. A coal nozzle assembly for a steam generation apparatus comprising an elongated nozzle body and an inner shell having two nozzle tips at one end thereof; the coal nozzle assembly further comprising means being located in the inner shell upstream of said two nozzle tips and splitting a stream of coal particles and primary air from said nozzle body into partial streams flowing through the two nozzle tips, the directions of the flow paths of the two nozzle tips enclosing an angle (α) greater than 0° and equal to or less than 90°, wherein the two partial streams are redirected by means of the two nozzle tips such that they intersect and shear against each other upon exit of the nozzle tip before they are combusted.

5. Coal nozzle assembly according to claim 4 wherein that the nozzle tips are mounted for pivotal movement about an axis being orthogonal with respect to the longitudinal axis of the elongate body or the inner shell.

6. Coal nozzle assembly according to claim 4 wherein at least one of the nozzle body or the inner shell and the nozzle tips partially overlap.

7. Coal nozzle assembly according to in claim 4 wherein the assembly further comprises an air housing.

8. Coal nozzle assembly according to claim 7 wherein at least one of the nozzle body and/or the inner shell and the nozzle tips as well as the air housing limit at least one channel for conveying secondary air.

9. Coal nozzle assembly according to claim 4 wherein at least one of the nozzle body and/or the inner shell have at least one of a rectangular or truncated pyramid longitudinal section.

10. Coal nozzle assembly according to claim 4 wherein that the directions of the flow paths of the channels at their ends distal from the nozzle body enclose an angle that is at least one of greater than 15°; or greater than 30°; and/or less than 75°; or less than 60°.

11. Coal nozzle assembly according to claim 4 wherein each nozzle tip comprises exit faces and at least one shear bar arranged near the exit faces.

12. Coal nozzle assembly according to claim 4 wherein the assembly comprises at least one splitter plate to direct the flow of air and coal particles.

13. Coal nozzle assembly according to claim 4 wherein that a catalyst is applied to the internal walls of the nozzle tip.

14. Coal nozzle assembly according to claim 13 wherein that the catalyst is a perovskite-type catalyst with catalytic activity in a preferred temperature range, of 500° C. to 900° C.

15. Coal nozzle assembly according to claim 13 wherein that the catalyst is Lanthanum Strontium Titanate doped with metals.

* * * * *